US009132322B1

(12) United States Patent
Coley

(10) Patent No.: US 9,132,322 B1
(45) Date of Patent: Sep. 15, 2015

(54) TENNIS RACKET

(71) Applicant: Kenneth R. Coley, Fairfield, CT (US)

(72) Inventor: Kenneth R. Coley, Fairfield, CT (US)

( * ) Notice: Subject to any disclaimer, the term of this patent is extended or adjusted under 35 U.S.C. 154(b) by 20 days.

(21) Appl. No.: 14/285,374

(22) Filed: May 22, 2014

(51) Int. Cl.
*A63B 49/02* (2015.01)

(52) U.S. Cl.
CPC ..... *A63B 49/02* (2013.01)

(58) Field of Classification Search
CPC .... A63B 49/00; A63B 49/002; A63B 49/005; A63B 49/02; A63B 51/00; A63B 51/08
USPC ..... 473/521, 539, 540, 543, 534, 542, 548
See application file for complete search history.

(56) References Cited

U.S. PATENT DOCUMENTS

| | | | | |
|---|---|---|---|---|
| 3,834,699 | A * | 9/1974 | Pass | 473/543 |
| 4,566,695 | A * | 1/1986 | Melby | 473/534 |
| 4,570,933 | A * | 2/1986 | Michiels | 473/539 |
| 4,750,742 | A * | 6/1988 | Coupar | 473/540 |
| 4,861,029 | A * | 8/1989 | Takatsuka | 473/540 |
| 5,386,991 | A * | 2/1995 | Rochette | 473/540 |
| 6,344,006 | B1 * | 2/2002 | Brandt | 473/543 |
| 7,081,056 | B2 * | 7/2006 | Brandt | 473/543 |
| 2001/0031676 | A1 * | 10/2001 | Luskin et al. | 473/524 |
| 2002/0098925 | A1 * | 7/2002 | Brandt | 473/543 |
| 2006/0211526 | A1 * | 9/2006 | Hauptman | 473/524 |
| 2009/0165243 | A1 * | 7/2009 | Yazdi | 16/2.1 |
| 2012/0214625 | A1 * | 8/2012 | Brandt | 473/543 |
| 2013/0203529 | A1 * | 8/2013 | Brandt et al. | 473/539 |

FOREIGN PATENT DOCUMENTS

| | | | |
|---|---|---|---|
| WO | WO 2009134974 A1 * | 11/2009 | A63B 51/00 |

* cited by examiner

*Primary Examiner* — Raleigh W Chiu
(74) *Attorney, Agent, or Firm* — Crossley Patent Law

(57) ABSTRACT

A tennis racket including a shaft that has a handle and a head attached thereto having a diamond-shaped frame. A length dimension of the frame is longer than a width thereof and is parallel to the shaft. A string groove is continuously disposed around the frame. A plurality of string holes is disposed within the string groove. A single length of string is continuously disposed through the string holes to string the tennis racket. A pair of tie off members is centrally disposed within the string groove on one side of the frame proximal a first corner of the frame. A central portion of the string centrally disposed within the frame forms a sweet spot which is larger than the sweet spots of other tennis rackets due to the diamond shape of the frame thereby propelling the tennis ball with more power and a more accurate aim.

7 Claims, 4 Drawing Sheets

TENNIS RACKET

BACKGROUND OF THE INVENTION

Various types of tennis rackets are in use and are known in the prior art. However, what is needed is a tennis racket that has a diamond-shaped frame that provides a larger sweet spot than prior art tennis rackets.

FIELD OF THE INVENTION

The present invention relates to a tennis racket, and more particularly, to a tennis racket that has a diamond-shaped frame that provides a larger sweet spot than prior art tennis rackets.

SUMMARY OF THE INVENTION

The general purpose of the present tennis racket, described subsequently in greater detail, is to provide a tennis racket which has many novel features that results in a tennis racket which is not anticipated, rendered obvious, suggested, or even implied by prior art, either alone or in combination thereof.

The present invention disclosed herein is a tennis racket including a shaft that has a handle and a head attached to the handle. The head includes a diamond-shaped frame. The frame has a top left side, a top right side, a bottom left side and a bottom right side. A length of the frame is greater than a width thereof and is disposed in a position parallel to the shaft. A string groove is continuously disposed along an outer perimeter of the frame. A plurality of string holes is disposed in the string groove. A single length of string is disposed through a pair of directly opposite string holes in a first and a second portion of strings to properly string the tennis racket. The length of string is fixedly attached to the frame by a pair of tie off members. The unique diamond shape of the frame creates diagonal string segments of equal length, thus resulting in consistent tension over the entire surface area of the racket and also forming a larger and better "sweet spot" in a center portion of the strings.

Thus has been broadly outlined the more important features of the present tennis racket so that the detailed description thereof that follows may be better understood and in order that the present contribution to the art may be better appreciated.

DETAILED DESCRIPTION OF THE DRAWINGS

Figure 1:
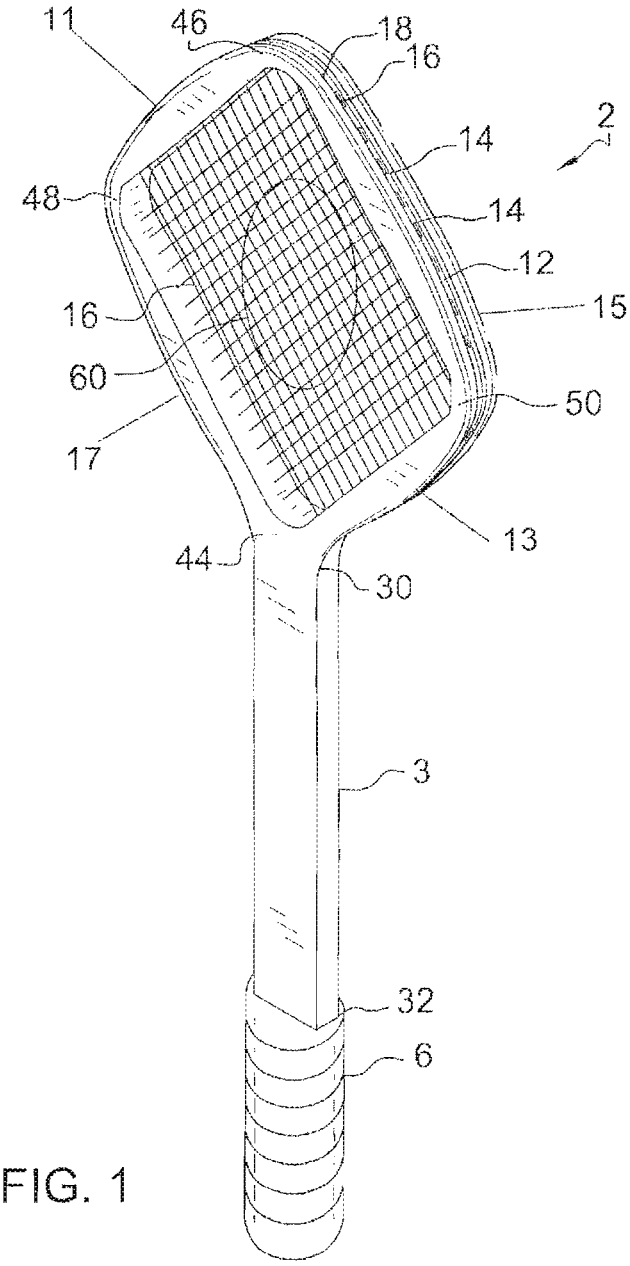
FIG. 1 is a perspective view.
Figure 2:
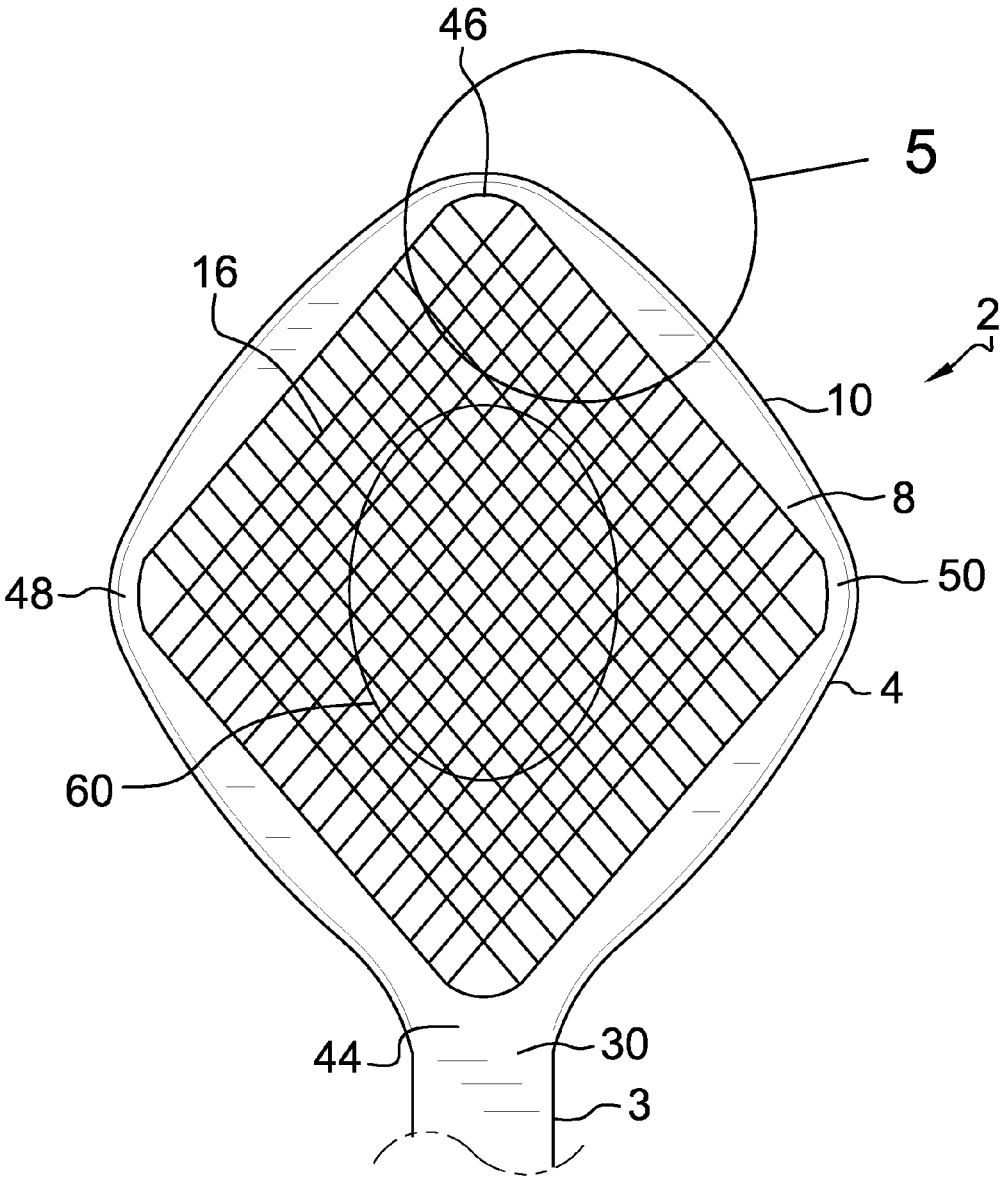
FIG. 2 is a front elevation view of a tennis racket head.
Figure 3:
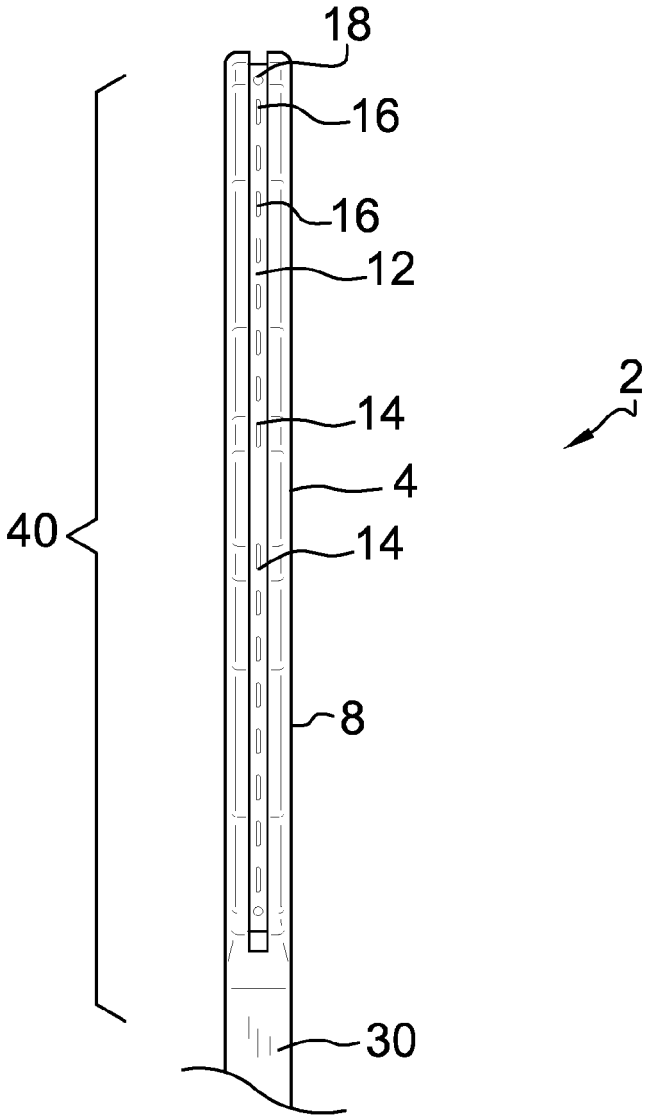
FIG. 3 is a side elevation view of the head.
Figure 4:
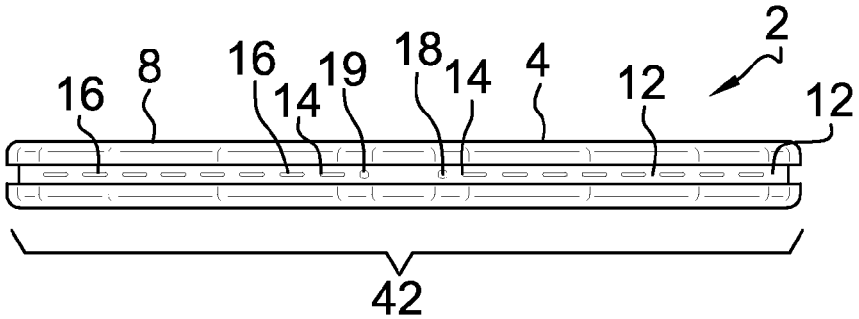
FIG. 4 is an end view of the head.
Figure 5:
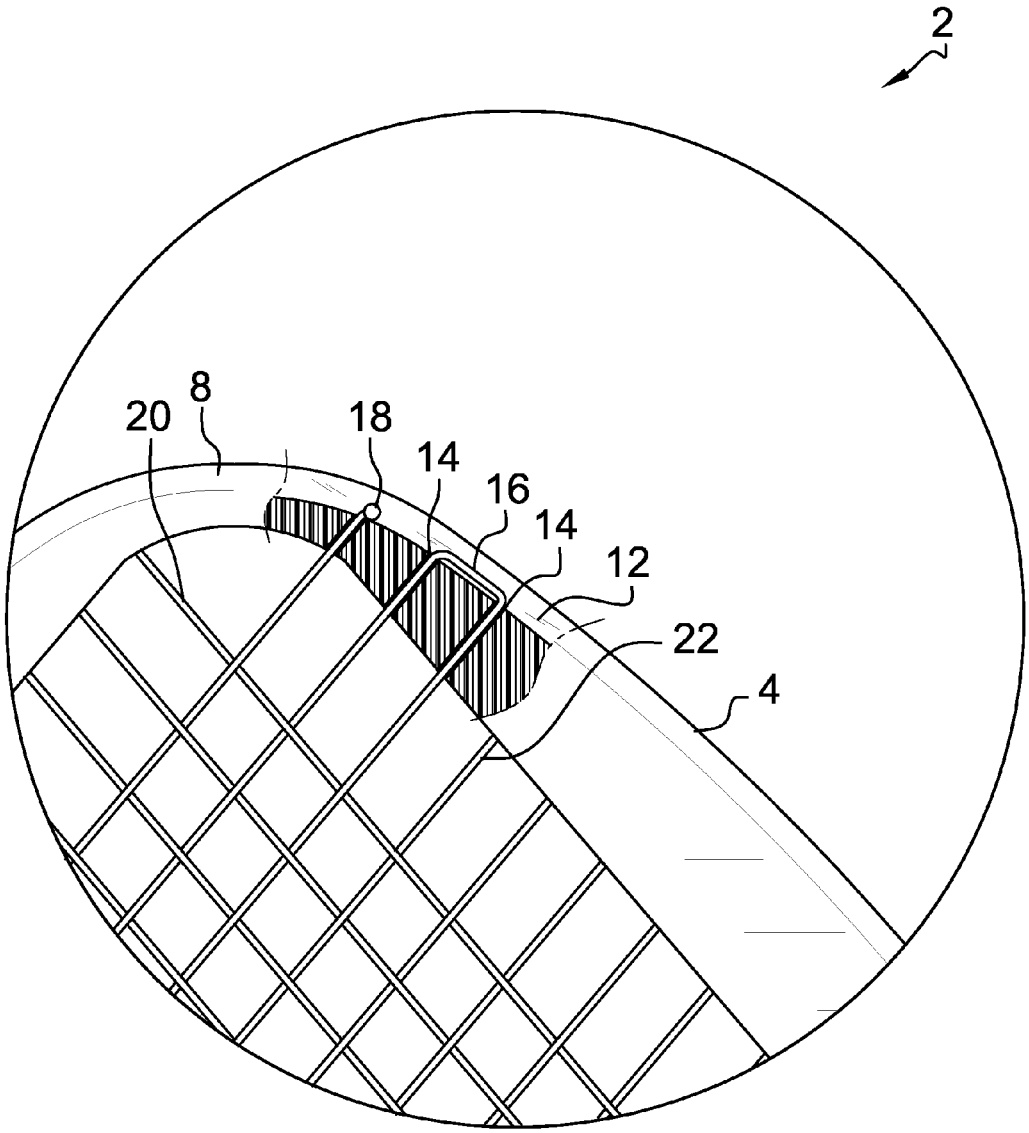
FIG. 5 is a detailed perspective view of the head taken from FIG. 2 highlighting string attachment to a frame.

With reference now to the drawings, and in particular FIGS. 1 through 5 thereof, an example of the tennis racket employing the principles and concepts of the present invention and generally designated by the reference number 2 will be described.

Referring to FIGS. 1 through 5, the present tennis racket 2 illustrated. The tennis racket 2 has a shaft 3 having a first end 30 and a second end 32. A head 4 is disposed on the first end 30 of the shaft 3 and a handle 6 is disposed on the second end 32 of the shaft 3.

The head 4 of the tennis racket 2 includes a diamond-shaped frame 8. The frame has a top left side, a top right side, a bottom left side and a bottom right side. The frame 8 has a length 40, a width 42, and four sides 10. The length 40 is continuously disposed from a connecting corner 44 to a diametrically opposed first corner 46. The frame 8 is attached to the shaft 3 at the connecting corner 44. The width 42 is continuously disposed from a first width corner 48 to a second width corner 50 of the frame 8. The length 40 of the frame 8 is greater than the width 42. The first width corner 48 and the second width corner 50 are diametrically opposed to each other and are positioned at a right angle with respect to the connecting corner 44. Therefore, the length 40 is parallel to the shaft 3.

The frame 8 has a string groove 12 continuously disposed on an outer perimeter thereof. A plurality of spaced apart string holes 14 is continuously disposed along the string groove 12. A plurality of lengths of string 16 are provided and are divided into a first portion 20 and a second portion 22, which is intertwined with the a first portion 20 in a woven criss-cross configuration. A single length of string 16 engages each of a pair of the string holes 14 directly opposite each other in each of the first portion 20 and the second portion 22. Due to the diamond-shape of the frame 8, each length of string 16 of each of the first portion 20 and the second portion 22 has a same length, which results in a consistent tension throughout the racquet.

A pair of tie off members 18, 19 is centrally disposed within the string groove 12 on one side 10 of the frame 8 disposed proximal the first corner 46 to fixedly attach the string 16 to the frame 8. Each tie off member 18, 19 is cylindrical and extends outwardly from the string groove 12.

A central portion 60 of the intertwined a first portion 20 and the second portion 22 is centrally disposed between the sides 10 of the frame 8. Because of the consistent tension throughout the racquet, the central portion 60, also known as a "sweet spot," is larger than in conventional racquets. The central portion 60 forms a sweet spot that is larger than the sweet spot of prior art tennis rackets due to the diamond shape of the frame 8. The sweet spot 60 is a point that propels the tennis ball with the most power, the least vibration to the user's hands, and the most accurate aim.

The invention claimed is:

1. A tennis racket comprising:

a shaft having a first end and a second end;

a handle disposed on the second end of the shaft;

a head disposed on the first end of the shaft, the head comprising a diamond-shaped frame having a top left side, a top right side, a bottom left side and a bottom right side;

an outer perimeter of the frame a string groove continuously disposed on the outer perimeter;

a plurality of spaced apart string holes continuously disposed along the string groove;

a plurality of lengths of string, the lengths of string comprising first and second portions, said first and second portions intertwined with each other in a woven criss-cross configuration;

wherein the first portion is disposed from the frame top left side to the frame bottom right side;

wherein the second portion is disposed from the frame top right side to the frame bottom left side;

wherein a single one of the lengths of string engages each of a pair of the string holes directly opposite each other in each of the first and second portions; and a pair of tie off members centrally disposed within the string groove on one side of the four sides of the frame proximal the first corner;

wherein each single one of the lengths of string is fixedly attached to the pair of tie off members.

2. The tennis racket of claim 1 wherein the frame further comprises:

a quartet of corners, said corners comprising a connecting corner, the connecting corner being located at the point where the frame of the head connects to the shaft;

an opposite corner, wherein the opposite corner is positioned opposing to the connecting corner;

a first width corner, wherein the first width corner is positioned on the frame ninety degrees from the connecting corner;

a second width corner, wherein the second width corner is positioned on the frame ninety degrees from the connecting corner; wherein the second width corner is positioned on the frame one hundred eighty degrees from the first width corner;

a length of the frame continuously disposed from the connecting corner to the opposite corner; and a width of the frame continuously disposed from the first width corner to the second width corner, wherein the length of the frame is longer than the width of the frame.

3. The tennis racket of claim 2 further comprising:

a central portion of the intertwined first portion and the second portion, wherein the central portion is centrally disposed between the sides of the frame;

wherein the central portion is configured to provide a larger sweet spot than existing tennis rackets.

4. The tennis racket of claim 1 further comprising:

a central portion of the intertwined first portion and the second portion, wherein the central portion is centrally disposed between the sides of the frame;

wherein the central portion is configured to provide a larger sweet spot than existing tennis rackets.

5. The tennis racket of claim 4 wherein the length of the frame is parallel to the shaft.

6. The tennis racket of claim 1 wherein the length of the frame is parallel to the shaft.

7. A tennis racket comprising:

a shaft having a first end and a second end;

a handle disposed on the second end of the shaft;

a head disposed on the first end of the shaft, the head comprising a diamond-shaped frame having a top left side, a top right side, a bottom left side and a bottom right side, the frame comprising:

a quartet of corners, said corners comprising a connecting corner, the connecting corner being located at the point where the frame of the head connects to the shaft;

an opposite corner, wherein the opposite corner is positioned opposing to the connecting corner;

a first width corner, wherein the first width corner is positioned on the frame ninety degrees from the connecting corner;

a second width corner, wherein the second width corner is positioned on the frame ninety degrees from the connecting corner; wherein the second width corner is positioned on the frame one hundred eighty degrees from the first width corner;

a length of the frame continuously disposed from the connecting corner to the opposite corner, the length of the frame further being parallel to the shaft; and a width of the frame continuously disposed from the first width corner to the second width corner, wherein the length of the frame is longer than the width of the frame;

a string groove continuously disposed on an outer perimeter of the frame;

a plurality of spaced apart string holes continuously disposed along the string groove;

a plurality of lengths of string, the lengths of string comprising a first portion and a second portion intertwined with the first portion in a woven criss-cross configuration;

wherein the first portion is disposed from the frame top left side to the frame bottom right side;

wherein the second portion is disposed from the frame top right side to the frame bottom left side;

wherein a single one of the lengths of string engages each of a pair of the string holes directly opposite each other in each of the first and second portions; and a central portion of the intertwined first portion and the second portion, wherein the central portion is centrally disposed between the sides of the frame; and a pair of tie off members centrally disposed within the string groove on one side of the four sides of the frame proximal the first corner;

wherein each single one of the lengths of string is fixedly attached to the pair of tie off members;

wherein the central portion is configured to provide a larger sweet spot than existing tennis rackets.

* * * * *